US010797376B2

(12) United States Patent
Tu et al.

(10) Patent No.: US 10,797,376 B2
(45) Date of Patent: Oct. 6, 2020

(54) COMMUNICATION DEVICE

(71) Applicant: Quanta Computer Inc., Taoyuan (TW)

(72) Inventors: Shu-Yang Tu, Taoyuan (TW); Chun-I Lin, Taoyuan (TW); Hui Lin, Taoyuan (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 0 days.

(21) Appl. No.: 16/517,888

(22) Filed: Jul. 22, 2019

(65) Prior Publication Data

US 2020/0274227 A1 Aug. 27, 2020

(30) Foreign Application Priority Data

Feb. 23, 2019 (TW) ..... 108106135 A

(51) Int. Cl.
*H01Q 1/24* (2006.01)
*H01Q 1/38* (2006.01)

(52) U.S. Cl.
CPC ..... *H01Q 1/24* (2013.01); *H01Q 1/38* (2013.01)

(58) Field of Classification Search
CPC ..... H01Q 1/24; H01Q 1/241; H01Q 1/242; H01Q 1/243; H01Q 1/38; H01Q 1/226; H01Q 9/045; H01Q 9/0421; H01Q 9/0435; H01Q 9/30; H01Q 5/335; H01Q 5/357; H01Q 5/328; H01Q 13/10
See application file for complete search history.

(56) References Cited

U.S. PATENT DOCUMENTS

| | | | | |
|---|---|---|---|---|
| 7,825,863 | B2 * | 11/2010 | Martiskainen | H01Q 1/243 343/702 |
| 9,112,269 | B2 * | 8/2015 | Wong | H01Q 9/30 |
| 9,300,045 | B2 * | 3/2016 | Wong | H01Q 5/20 |
| 9,979,071 | B2 * | 5/2018 | Hsieh | H01Q 1/22 |
| 9,979,074 | B2 * | 5/2018 | Chen | H01Q 5/371 |
| 10,542,130 | B1 * | 1/2020 | Lo | H04M 1/0266 |
| 10,741,915 | B2 * | 8/2020 | Chen | H01Q 5/335 |
| 2009/0322639 | A1 | 12/2009 | Lai | |
| 2018/0048076 | A1 * | 2/2018 | Wei | H01Q 9/045 |

OTHER PUBLICATIONS

Chinese language office action dated Feb. 12, 2020, issued in application No. TW 108106135.

* cited by examiner

*Primary Examiner* — Haissa Philogene
(74) *Attorney, Agent, or Firm* — McClure, Qualey & Rodack, LLP

(57) ABSTRACT

A communication device includes a ground element, a dielectric substrate, and an antenna element. The dielectric substrate is disposed adjacent to an edge of the ground element. The antenna element is disposed on the dielectric substrate. The antenna element includes a feeding metal element, a shorting metal element, a first radiation metal element, a second radiation metal element, and an inductive element. The feeding metal element has a feeding point. The shorting metal element is coupled to the ground element. The first radiation metal element is coupled to the shorting metal element, and is disposed adjacent to the feeding metal element. The second radiation metal element is coupled through the inductive element to the feeding metal element. The second radiation metal element is further coupled to the ground element.

10 Claims, 6 Drawing Sheets

COMMUNICATION DEVICE

CROSS REFERENCE TO RELATED APPLICATIONS

This application claims priority of Taiwan Patent Application No. 108106135 filed on Feb. 23, 2019, the entirety of which is incorporated by reference herein.

BACKGROUND OF THE INVENTION

Field of the Invention

The disclosure generally relates to a communication device, and more particularly, it relates to a communication device and an antenna element therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for mobile devices supporting wireless communication. Notebook computers are used as an example. In order to satisfy consumer demands for narrow borders, the antenna design space of notebook computers is very limited. Therefore, it has become a critical challenge for current engineers to design a wideband antenna element that is small in size.

BRIEF SUMMARY OF THE INVENTION

In an exemplary embodiment, the disclosure is directed to a communication device which includes a ground element, a dielectric substrate, and an antenna element. The dielectric substrate is disposed adjacent to an edge of the ground element. The antenna element is disposed on the dielectric substrate. The antenna element includes a feeding metal element, a shorting metal element, a first radiation metal element, a second radiation metal element, and an inductive element. The feeding metal element has a feeding point. The shorting metal element is coupled to the ground element. The first radiation metal element is coupled to the shorting metal element, and is disposed adjacent to the feeding metal element. The second radiation metal element is coupled through the inductive element to the feeding metal element. The second radiation metal element is further coupled to the ground element.

In some embodiments, the first radiation metal element substantially has an L-shape.

In some embodiments, the antenna element further includes a matching metal element coupled to the second radiation metal element.

In some embodiments, the distance between the matching metal element and the edge of the ground element is shorter than or equal to 5 mm.

In some embodiments, the dielectric substrate has a first surface and a second surface which are opposite to each other. The feeding metal element, the shorting metal element, the second radiation metal element, and the matching metal element are disposed on the first surface of the dielectric substrate. The first radiation metal element is disposed on the second surface of the dielectric substrate.

In some embodiments, the antenna element further includes a conductive via element penetrating the dielectric substrate. The first radiation metal element is coupled through the conductive via element to the shorting metal element.

In some embodiments, the antenna element covers a first frequency band and a second frequency band. The first frequency band is from 2400 MHz to 2500 MHz. The second frequency band is from 5150 MHz to 5850 MHz.

In some embodiments, the inductive element is a chip inductor or a printed inductor.

In some embodiments, the dielectric substrate has a first surface and a second surface which are opposite to each other. The feeding metal element, the shorting metal element, the first radiation metal element, and the second radiation metal element are disposed on the first surface of the dielectric substrate.

In some embodiments, the second radiation metal element includes a first portion and a second portion, and a partition gap is formed between the first portion and the second portion.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
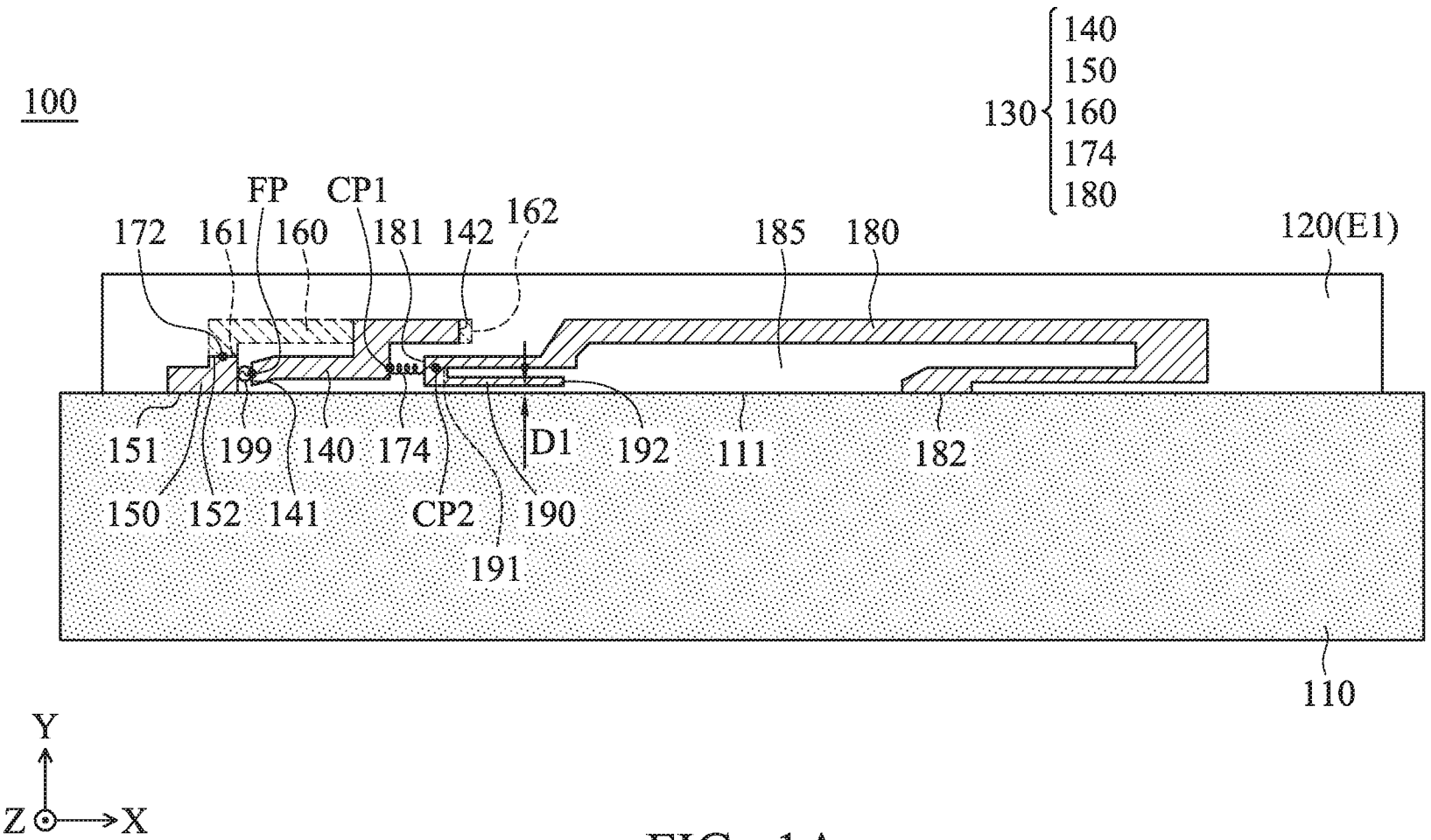
FIG. 1A is a top view of a communication device according to an embodiment of the invention.
Figure 1B:
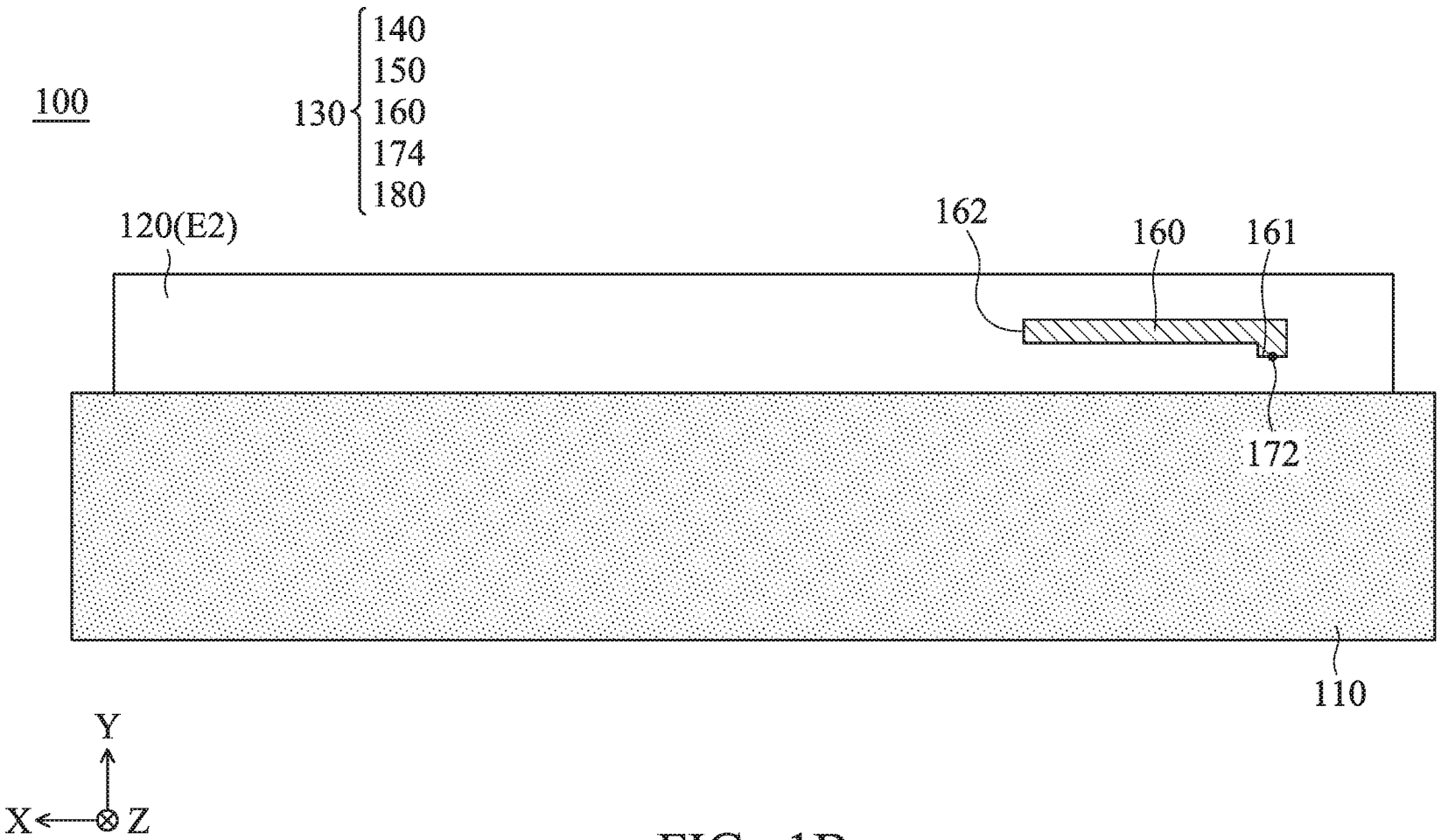
FIG. 1B is a back view of a communication device according to an embodiment of the invention.

FIG. 1A is a top view of a communication device 100 according to an embodiment of the invention. FIG. 1B is a back view of the communication device 100 according to an embodiment of the invention. Please refer to FIG. 1A and FIG. 1B together. The communication device 100 may be a smart phone, a tablet computer, or a notebook computer. As shown in FIG. 1A and FIG. 1B, the communication device 100 at least includes a ground element 110, a dielectric substrate 120, and an antenna element 130. It should be understood that the communication device 100 may further include other components, such as a display device, a speaker, a touch control module, a power supply module, and a housing, although they are not displayed in FIG. 1A and FIG. 1B.

The ground element 110 may be made of a metal material, such as copper, silver, aluminum, iron, or their alloys. The ground element 110 has an edge 111. The shape and size of the ground element 110 are not limited in the invention. The dielectric substrate 120 may be a PCB (Printed Circuit Board), an FCB (Flexible Circuit Board), or an FR4 (Flame Retardant 4) substrate. The dielectric substrate 120 is disposed adjacent to the edge 111 of the ground element 110. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing therebetween is reduced to 0). The dielectric substrate 120 has a first surface E1 and a second surface E2 which are opposite to each other. In some embodiments, the dielectric substrate 120 substantially has a rectangular shape.

The antenna element 130 is disposed on the dielectric substrate 120. Specifically, the antenna element 130 at least includes a feeding metal element 140, a shorting metal element 150, a first radiation metal element 160, an inductive element 174, and a second radiation metal element 180. The feeding metal element 140, the shorting metal element 150, the inductive element 174, and the second radiation metal element 180 are all disposed on the first surface E1 of the dielectric substrate 120. The first radiation metal element 160 is disposed on the second surface E2 of the dielectric substrate 120.

The feeding metal element 140 may substantially have a meandering shape, such as an N-shape or a Z-shape, but it is not limited thereto. The feeding metal element 140 has a first end 141 and a second end 142. A feeding point FP is positioned at the first end 141 of the feeding metal element 140. The second end 142 of the feeding metal element 140 is an open end. The feeding point FP may be coupled to a positive electrode of a signal source 199. For example, the signal source 199 may be an RF (Radio Frequency) module for exciting the antenna element 130. In some embodiments, the feeding metal element 140 is partially parallel to the edge 111 of the ground element 110, and is partially perpendicular to the edge 111 of the ground element 110.

The shorting metal element 150 may substantially have a rectangular shape, a square shape, or an L-shape, but it is not limited thereto. The shorting metal element 150 has a first end 151 and a second end 152. The first end 151 of the shorting metal element 150 is coupled to the edge 111 of the ground element 110. A negative electrode of the signal source 199 may be coupled to any position on the shorting metal element 150. The shorting metal element 150 is considered as an extension portion of the ground element 110 on the first surface E1 of the dielectric substrate 120.

The first radiation metal element 160 may substantially have an L-shape or a straight-line shape, but it is not limited thereto. The first radiation metal element 160 is adjacent to or opposite to the feeding metal element 140. Specifically, if the feeding metal element 140 has a vertical projection on the second surface E2 of the dielectric substrate 120, the vertical projection of the feeding metal element 140 may at least partially overlap the first metal radiation element 160, so as to enhance the coupling effect between the feeding metal element 140 and the first radiation metal element 160. The first radiation metal element 160 has a first end 161 and a second end 162. The first end 161 of the first radiation metal element 160 is coupled to the second end 152 of the shorting metal element 150. The second end 162 of the first radiation metal element 160 is an open end, which extends to be substantially parallel to the edge 111 of the ground element 110. In some embodiments, the antenna element 130 of the communication device 100 further includes a conductive via element 172. The conductive via element 172 penetrates the dielectric substrate 120, and thus the first end 161 of the first radiation metal element 160 is coupled through the conductive via element 172 to the second end 152 of the shorting metal element 150. It should be understood that the conductive via element 172 is an optional element, which is omitted in other embodiments.

The inductive element 174 may be a chip inductor, a printed inductor, or a combination thereof. The inductive element 174 is coupled to a first connection point CP1 on the feeding metal element 140. The first connection point CP1 may be substantially positioned on a bending portion of the feeding metal element 140, and the bending portion may be positioned between the first end 141 and the second end 142 of the feeding metal element 140. The inductance of the inductive element 174 may be from 2 nH to 20 nH, such as 4.3 nH, but it is not limited thereto.

The second radiation metal element 180 may substantially have a meandering shape, and it may be an equal-width structure or a variable-width structure. The second radiation metal element 180 has a first end 181 and a second end 182. The first end 181 of the second radiation metal element 180 is coupled through the inductive element 174 to the first connection point CP1 on the feeding metal element 140. The second end 182 of the second radiation metal element 180 is coupled to the edge 111 of the ground element 110. Accordingly, a closed-loop path is formed by the feeding metal element 140, the inductive element 174, the second radiation metal element 180, and the ground element 110, and a non-metal region 185 is surrounded by the closed-loop path.

In some embodiments, the antenna element 130 further includes a matching metal element 190, which is disposed on the first surface E1 of the dielectric substrate 120 and is positioned inside the aforementioned closed-loop path. The matching metal element 190 may substantially have a straight-line shape or an L-shape. The matching metal element 190 has a first end 191 and a second end 192. The first end 191 of the matching metal element 190 is coupled to a second connection point CP2 on the second radiation metal element 180. The second end 192 of the matching metal element 190 is an open end, which extends to be substantially parallel to the edge 111 of the ground element 110. For example, the second connection point CP2 may be adjacent to the first end 181 of the second radiation metal element 180. It should be understood that the matching metal element 190 is an optional element, which is omitted in other embodiments.

Figure 2:
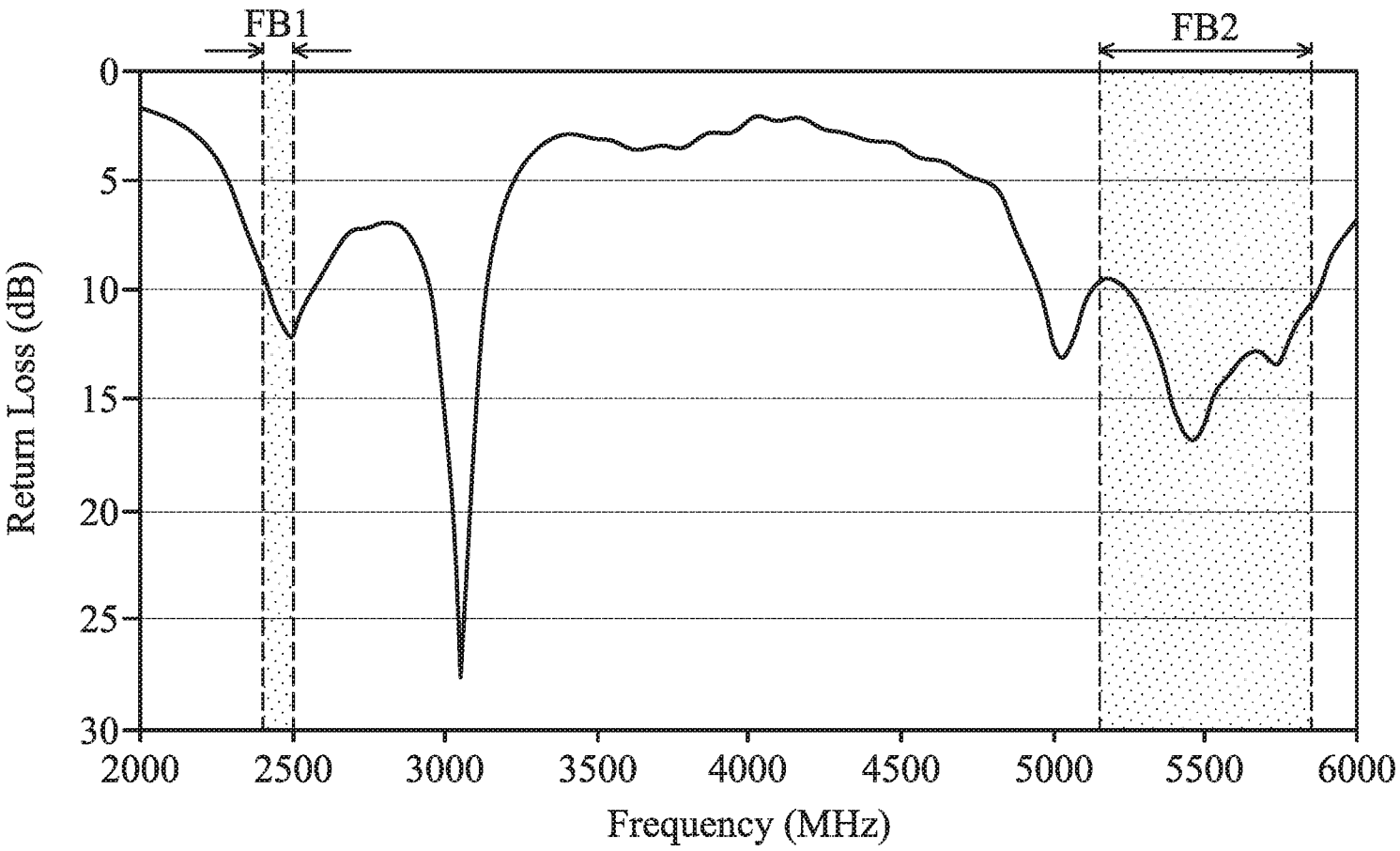
FIG. 2 is a diagram of return loss of an antenna element of a communication device according to an embodiment of the invention.

FIG. 2 is a diagram of return loss of the antenna element 130 of the communication device 100 according to an embodiment of the invention. The horizontal axis represents the operation frequency (MHz), and the vertical axis represents the return loss (dB). According to the measurement of FIG. 2, the antenna element 130 can cover a first frequency band FB1 and a second frequency band FB2. The first frequency band FB1 may be from 2400 MHz to 2500 MHz. The second frequency band FB2 may be from 5150 MHz to 5850 MHz. Therefore, the antenna element 130 can support at least the dual-band operations of WLAN (Wireless Local Area Networks) 2.4 GHz/5 GHz. According to practical measurement, the radiation efficiency of the antenna element 130 is about 35% within the first frequency band FB1, and the radiation efficiency of the antenna element 130 is about 30% within the second frequency band FB2. It can meet the requirements of practical applications of general mobile communication devices.

In some embodiments, the operation principles of the antenna element 130 are described as follows. The second radiation metal element 180 is directly excited by the feeding metal element 140, so as to generate the aforementioned first frequency band FB1. The first radiation metal element 160 is excited by the feeding metal element 140 using a coupling mechanism, so as to generate the aforementioned second frequency band FB2. The inductive element 174 is configured to increase the effective resonant length of the second radiation metal element 180, thereby minimizing the total size of the antenna element 130. Furthermore, the inductive element 174 prevents the resonant currents of the second frequency band FB2 from flowing into the second radiation metal element 180, so as to reduce the interference between the first frequency band FB1 and the second frequency band FB2. The matching metal element 190 is mainly configured to fine-tune the impedance matching of the second frequency band FB2, thereby increasing the operation bandwidth of the second frequency band FB2.

In some embodiments, the element sizes of the communication device 100 are described as follows. The length of the ground element 110 may be about 280 mm, and the width of the ground element 110 may be about 180 mm. The thickness of the dielectric substrate 120 (i.e., the distance/spacing between the first surface E1 and the second surface E2) may be shorter than 2 mm, such as about 0.4 mm. The length of the antenna element 130 may be about 55 mm, and the height of the antenna element 130 (i.e., the height on the edge 111 of the ground element 110, parallel to the Y-axis) may be about 3 mm. The length of the first radiation metal element 160 (i.e., the length from the first end 161 to the second end 162) may be shorter than or equal to 0.25 wavelength ($\lambda/4$) of the central frequency of the second frequency band FB2, such as about 11 mm. The length of the second radiation metal element 180 (i.e., the length from the first end 181 to the second end 182) may be shorter than or equal to 0.5 wavelength ($\lambda/2$) of the central frequency of the first frequency band FB1, such as about 45 mm. The length of the second radiation metal element 180 may be longer than the length of the first radiation metal element 160. Specifically, the length of the second radiation metal element 180 may 1.5 to 3 times the length of the first radiation metal element 160. The distance D1 between the matching metal element 190 and the edge 111 of the ground element 110 may be shorter than or equal to 5 mm, such as about 0.5 mm. The above ranges of element sizes are calculated and obtained according to many experiment results, and they help to optimize the operation bandwidth and impedance matching of the antenna element 130 of the communication device 100.

Figure 3:
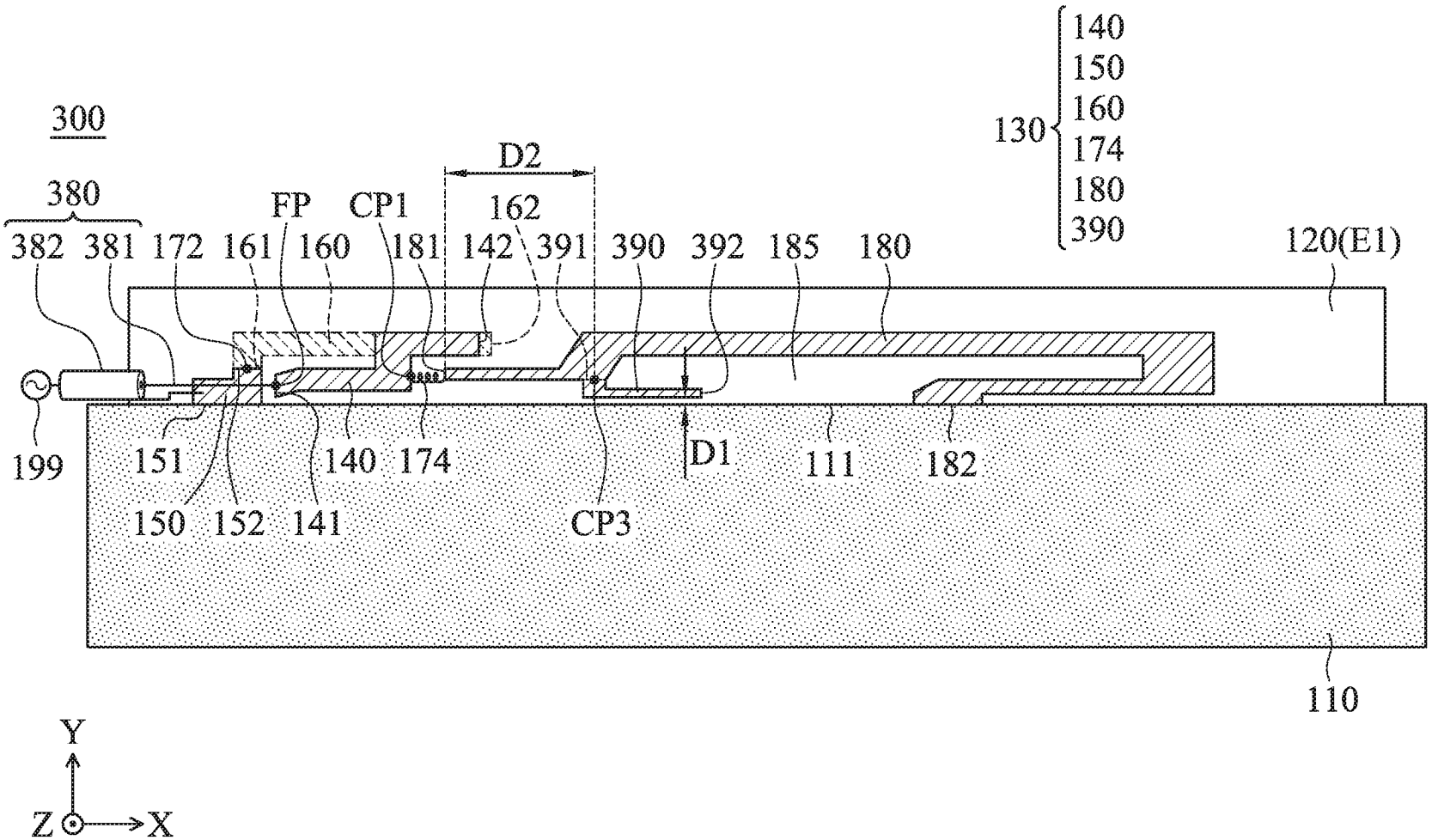
FIG. 3 is a top view of a communication device according to another embodiment of the invention.

FIG. 3 is a top view of a communication device 300 according to another embodiment of the invention. FIG. 3 is similar to FIG. 1A. In the embodiment of FIG. 3, the position of a matching metal element 390 of the communication device 300 is slightly moved. The matching metal element 390 has a first end 391 and a second end 392. The first end 391 of the matching metal element 390 is coupled to a second connection point CP3 on the second radiation metal element 180. The second end 392 of the matching metal element 390 is an open end, which extends to be substantially parallel to the edge 111 of the ground element 110. For example, the second connection point CP3 may be adjacent to a bending portion of the second radiation metal element 180. According to practical measurements, if the distance D2 between the second connection point CP3 and the first end 181 of the second radiation metal element 180 is shorter than 0.2 times the length of the second radiation metal element 180, the antenna element 130 can provide better radiation performance. In addition, the communication device 300 further includes a coaxial cable 380. The coaxial cable 380 includes a central conductive line 381 and a conductive housing 382. The positive electrode of the signal source 199 may be coupled through the central conductive line 381 to the feeding point FP. The negative electrode of the signal source 199 may be coupled through the conductive housing 382 to the shorting metal element 150. It should be noted that the conductive housing 382 of the coaxial cable 380 is coupled to the shorting metal element 150, instead of being directly coupled to the ground element 110 as conventional designs, and therefore such a proposed design can significantly reduce the area occupied by the coaxial cable 380 on the first surface E1 of the dielectric substrate 120. According to practical measurements, with such a design, the height of the antenna element 130 on the Y-axis can be reduced to about 3 mm (conventional antenna height is usually greater than 5 mm), so as to meet the requirements of low-profile antenna designs. Other features of the communication device 300 of FIG. 3 are similar to those of the communication device 100 of FIG. 1A and FIG. 1B. Therefore, the two embodiments can achieve similar levels of performance.

Figure 4:
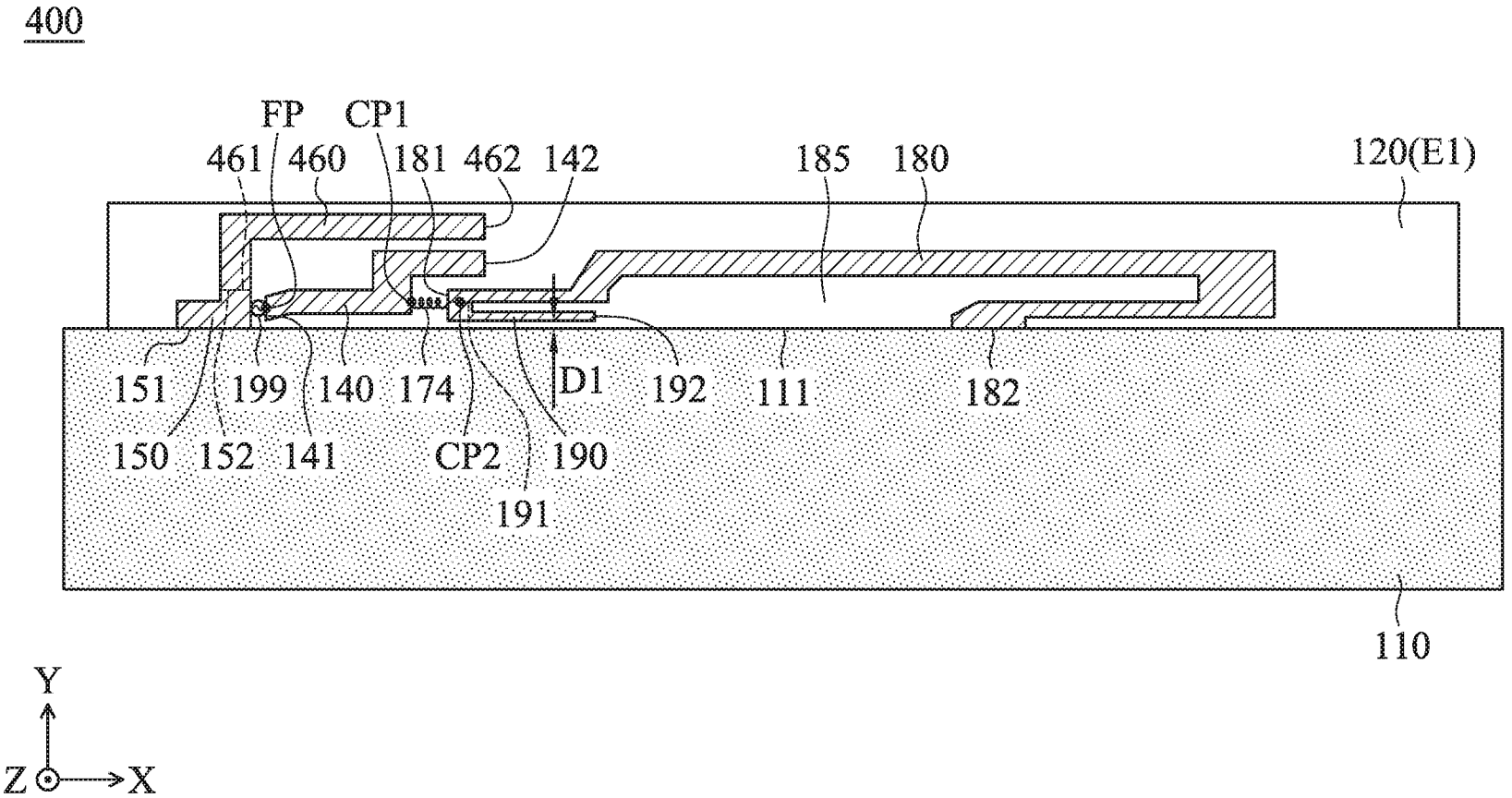
FIG. 4 is a top view of a communication device according to another embodiment of the invention.

FIG. 4 is a top view of a communication device 400 according to another embodiment of the invention. FIG. 4 is similar to FIG. 1A. In the embodiment of FIG. 4, a first radiation metal element 460 of the communication device 400 is disposed on the first surface E1 of the dielectric substrate 120. That is, the feeding metal element 140, the shorting metal element 150, the first radiation metal element 460, and the second radiation metal element 180 are coplanar designs. The first radiation metal element 460 may substantially have an L-shape. The first radiation metal element 460 has a first end 461 and a second end 462. The first end 461 of the first radiation metal element 460 is directly coupled to the second end 152 of the shorting metal element 150 (without communicating through the conductive via element 172, which is omitted). The second end 462 of the second radiation metal element 460 is an open end, which extends to be substantially parallel to the edge 111 of the ground element 110. It should be understood that the positions and shapes of the other elements of the communication device 400 are slightly adjusted to optimize the whole impedance matching. Other features of the communication device 400 of FIG. 4 are similar to those of the communication device 100 of FIG. 1A and FIG. 1B. Therefore, the two embodiments can achieve similar levels of performance.

Figure 5:
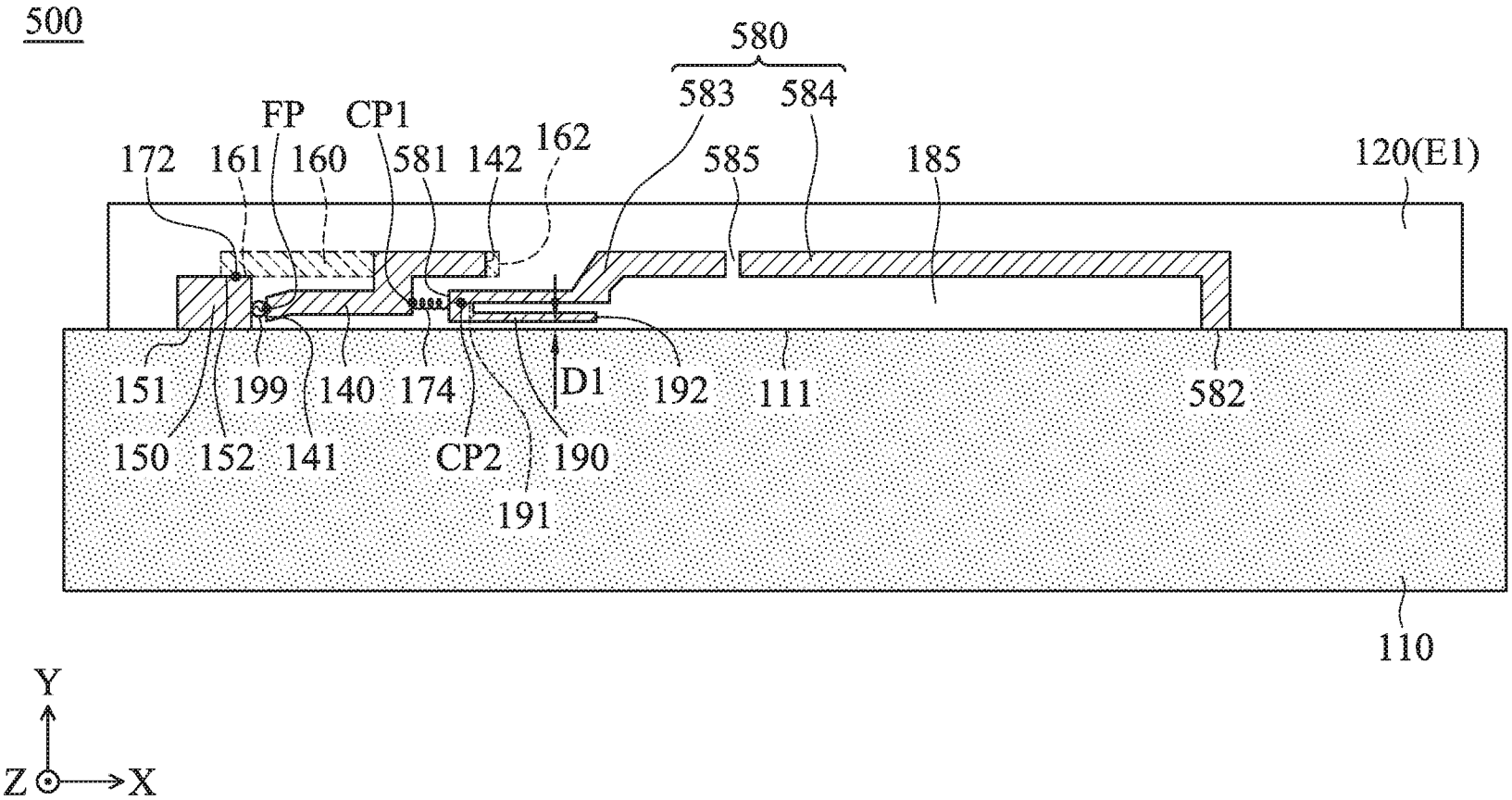
FIG. 5 is a top view of a communication device according to another embodiment of the invention.

FIG. 5 is a top view of a communication device 500 according to another embodiment of the invention. FIG. 5 is similar to FIG. 1A. In the embodiment of FIG. 5, a second radiation metal element 580 of the communication device 500 has a first end 581 and a second end 582 and includes a first portion 583 and a second portion 584. In the second radiation metal element 580, the first portion 583 is adjacent to the first end 581, and the second portion 584 is adjacent to the second end 582. Similarly, the first end 581 of the second radiation metal element 580 is coupled through the inductive element 174 to the first connection point CP1 on the feeding metal element 140, and the second end 582 of the second radiation metal element 580 is coupled to the edge 111 of the ground element 110. A partition gap 585 is formed between the first portion 583 and the second portion 584 of the second radiation metal element 580, and it completely separates the first portion 583 from the second portion 584. According to practical measurements, if the width of the partition gap 585 is smaller than 2 mm, there may be still a coupling effect between the first portion 583 and the second portion 584 of the second radiation metal element 580, such that the antenna radiation performance of the communication device 500 should not be negatively affected by the discontinuous structure of the second radiation metal element 580. It should be understood that the positions and shapes of the other elements of the communication device 500 are slightly adjusted to optimize the whole impedance matching. Other features of the communication device 500 of FIG. 5 are similar to those of the communication device 500 of FIG. 1A and FIG. 1B. Therefore, the two embodiments can achieve similar levels of performance.

The invention proposes a novel communication device and a novel antenna element. In comparison to the conventional designs, the invention has the advantages of small size, low profile, wide bandwidth, and low manufacturing cost, and therefore it is suitable for application in a variety of mobile communication devices with narrow borders.

Note that the above element sizes, element shapes, and frequency ranges are not limitations of the invention. An antenna designer can fine-tune these settings or values according to different requirements. It should be understood that the communication device and antenna element of the invention are not limited to the configurations of FIGS. 1-5. The invention may merely include any one or more features of any one or more embodiments of FIGS. 1-5. In other words, not all of the features displayed in the figures should be implemented in the communication device and antenna element of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A communication device, comprising:
- a ground element;
- a dielectric substrate, disposed adjacent to an edge of the ground element; and
- an antenna element, disposed on the dielectric substrate, wherein the antenna element comprises:
  - a feeding metal element, having a feeding point;
  - a shorting metal element, coupled to the ground element;
  - a first radiation metal element, coupled to the shorting metal element, and disposed adjacent to the feeding metal element;
  - an inductive element; and
  - a second radiation metal element, coupled through the inductive element to the feeding metal element, wherein the second radiation metal element is further coupled to the ground element.

2. The communication device as claimed in claim 1, wherein the first radiation metal element substantially has an L-shape.

3. The communication device as claimed in claim 1, wherein the antenna element further comprises:
- a matching metal element, coupled to the second radiation metal element.

4. The communication device as claimed in claim 3, wherein a distance between the matching metal element and the edge of the ground element is shorter than or equal to 5 mm.

5. The communication device as claimed in claim 3, wherein the dielectric substrate has a first surface and a second surface opposite to each other, wherein the feeding metal element, the shorting metal element, the second radiation metal element, and the matching metal element are disposed on the first surface of the dielectric substrate, and wherein the first radiation metal element is disposed on the second surface of the dielectric substrate.

6. The communication device as claimed in claim 5, wherein the antenna element further comprises:
- a conductive via element, penetrating the dielectric substrate, wherein the first radiation metal element is coupled through the conductive via element to the shorting metal element.

7. The communication device as claimed in claim 1, wherein the antenna element covers a first frequency band and a second frequency band, the first frequency band is from 2400 MHz to 2500 MHz, and the second frequency band is from 5150 MHz to 5850 MHz.

8. The communication device as claimed in claim 1, wherein the inductive element is a chip inductor or a printed inductor.

9. The communication device as claimed in claim 1, wherein the dielectric substrate has a first surface and a second surface opposite to each other, and wherein the feeding metal element, the shorting metal element, the first radiation metal element, and the second radiation metal element are disposed on the first surface of the dielectric substrate.

10. The communication device as claimed in claim 1, wherein the second radiation metal element comprises a first portion and a second portion, and a partition gap is formed between the first portion and the second portion.

* * * * *